United States Patent [19]

Rodak et al.

[11] 4,320,598

[45] Mar. 23, 1982

[54] DOOR DRAFT DEVICE

[76] Inventors: John J. Rodak; Regina E. Rodak, both of 600 Pickering Rd., Southampton, Pa. 18966

[21] Appl. No.: 133,208

[22] Filed: Mar. 24, 1980

[51] Int. Cl.[3] ..... E06B 7/16

[52] U.S. Cl. ..... 49/481; 49/488

[58] Field of Search ..... 49/480, 481, 488, 303, 49/306, 307, 308

[56] References Cited

U.S. PATENT DOCUMENTS 634,491 10/1899 Winter ..... 49/481

2,537,296 1/1951 Yeakel ..... 49/306

FOREIGN PATENT DOCUMENTS 3477 of 1914 United Kingdom .

693763 1/1953 United Kingdom .

*Primary Examiner*—Kenneth Downey

*Attorney, Agent, or Firm*—Seidel, Gonda, Goldhammer & Panitch

[57] ABSTRACT

The device is attachable to the lower end of a swinging door to control draft between a sill and the lower edge of the door. The device includes a roller supported at its ends by support assemblies which are removably attached to a pair of brackets on the door. Mating surfaces on each assembly and its associated bracket prevent cocking of the bracket. The ends of the roller are supported by a pair of support members which are non-rotatable, guided for vertical movement, and spring biased downwardly while being provided with an adjustable limit stop.

7 Claims, 4 Drawing Figures

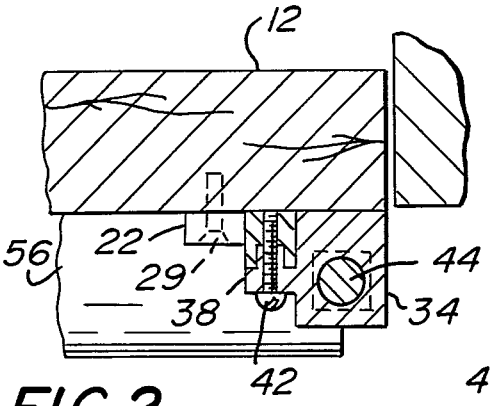
FIG. 2
FIG. 3
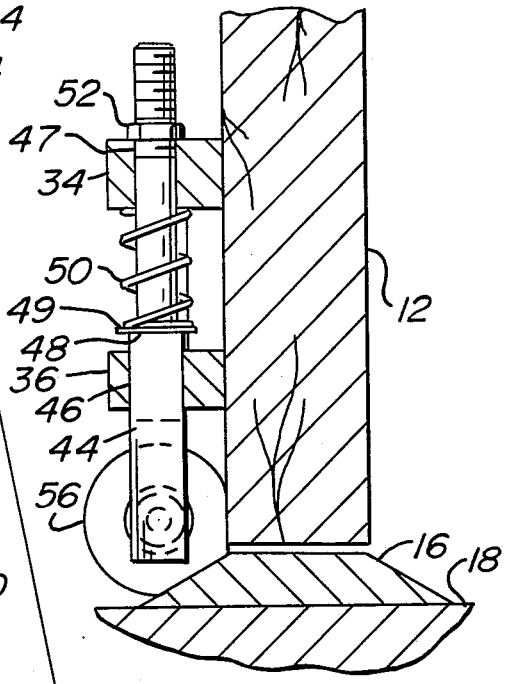
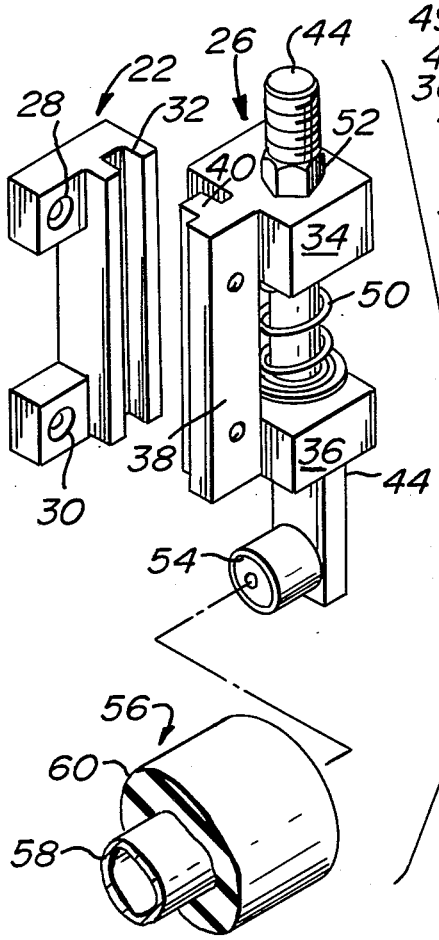
FIG. 4

DOOR DRAFT DEVICE

BACKGROUND

There is a need for a reliable device for controlling the draft beneath a door. A large number of such devices have been proposed heretofore including devices utilizing a roller. For examples of prior art disclosing a roller type draft device, see U.S. Pat. No. 634,491 of Winter, issued Oct. 10, 1899; British Pat. No. 693,763 of Evans, issued July 8, 1953; and British Patent 3477 of Shaw, issued Feb. 11, 1913. Notwithstanding the fact that roller type draft devices were known prior to the turn of the century, to our knowledge none is in commercial use since the constructions taught in such patents are deficient in many ways. The present invention is directed to a device structurally interrelated in a manner so as to overcome deficiencies of the prior art.

SUMMARY OF THE INVENTION

The door draft device of the present invention is adapted for attachment to the lower end of a swinging door and comprises:

a pair of mounting brackets each having a means for enabling the brackets to be secured to a door adjacent a side edge of the door, each bracket having a guide means on an exposed surface thereof;

a discrete roller support assembly for each bracket, means releasably securing each assembly to its associated bracket, each assembly including a guide surface mating with the guide means on its associated bracket in a manner so as to prevent each assembly from skewing and binding with respect to its bracket;

each assembly including a support member non-rotatably mounted thereon and guided for vertical movement, a spring biasing each support member downwardly, adjustable means for limiting the downward movement of each support member, the support members rotatably supporting a roller therebetween, the roller having a deformable outer surface substantially impervious to drafts;

whereby the assemblies and the roller may be removably separated from the brackets when desired.

It is an object of the present invention to provide a door draft device for substantially eliminating drafts from passing under doors which is easy to install, permits separation of the operative portions of the device with respect to brackets mounted on a door, while being structurally interrelated in manner so as to be more reliable than prior devices.

Other objects will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 2 is a sectional view taken along the line 2—2 in FIG. 1.

FIG. 3 is a sectional view taken along the line 3—3 in FIG. 1.

FIG. 4 is an exploded view of a roller support assembly and its associated mounting bracket.

DETAILED DESCRIPTION OF THE PREFERRED EMBODIMENTS

Figure 1:
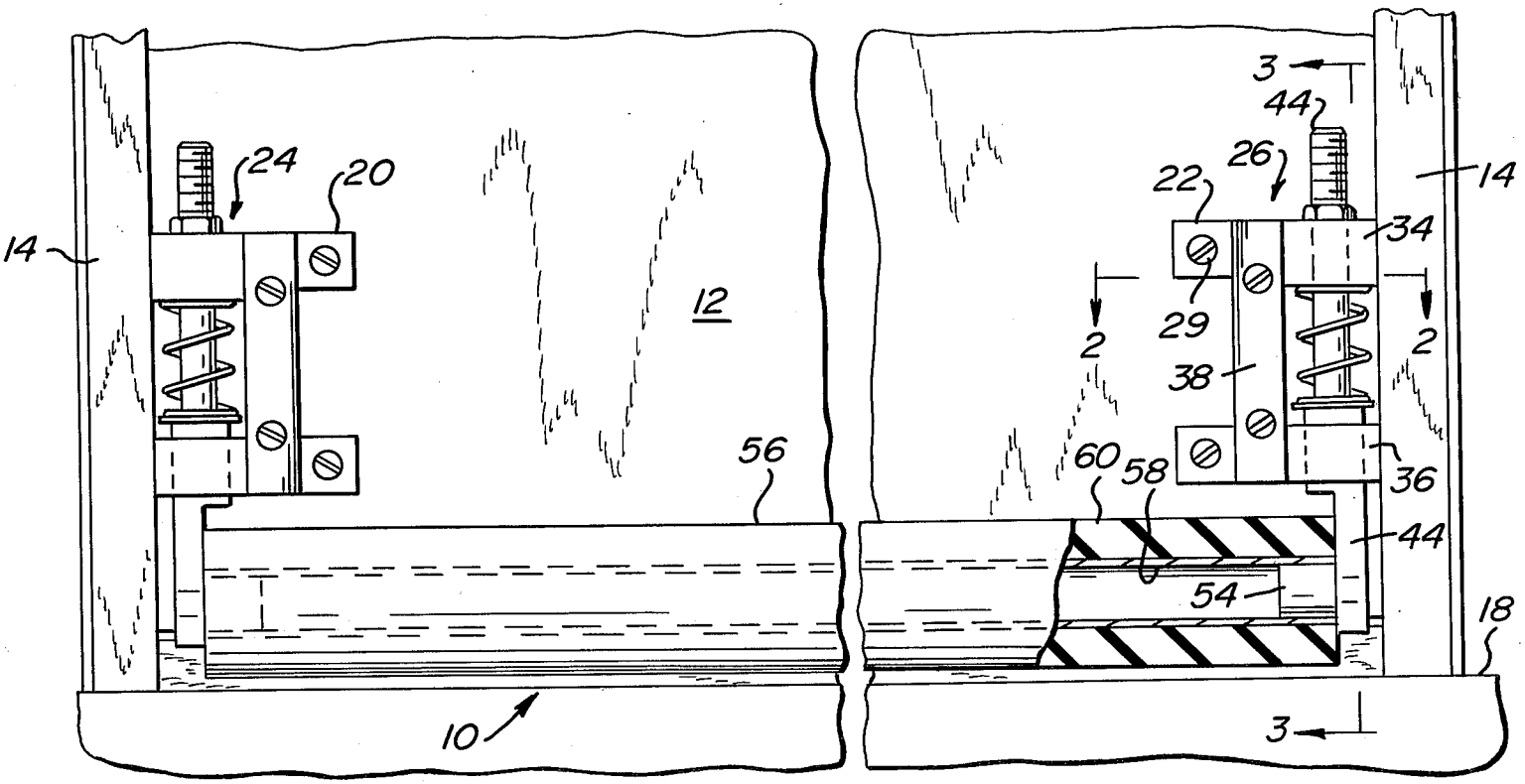
FIG. 1 is an elevation view of the invention, partly in section, shown mounted on the bottom end of a door mounted for swinging movement in a door frame.

Referring to the drawings in detail, wherein like numerals indicate like elements, there is shown in FIG. 1 a device in accordance with the present invention designated generally as 10 and secured to the lower end of a door 12. The door 12 is mounted for swinging movement about one of the door frames 14 in a conventional manner. As in usual door and frame assemblies, most of the space between the floor 18 and the lower end of the door 12 is occupied by a sill 16. See FIG. 3.

The device 10 includes a pair of brackets 20, 22 and a pair of roller support assemblies 24, 26. Since the brackets and the assemblies are identical, only bracket 22 and its associated assembly 26 will be described in detail. Corresponding structure is present on the bracket 20 and its associated assembly 24.

Referring to FIGS. 1 and 4, the bracket 22 includes a body having a pair of holes 28, 30 disposed one above the other. Fasteners such as screws 29 extend through the holes 28, 30 and secure the bracket 22 to the lower end of the door 12 adjacent to but spaced from the side edge of the door 12. Bracket 22 has a guide means for cooperation with mating structure on the assembly 26 to prevent skewing and binding of the assembly 26 relative to the bracket 22. The guide means on the bracket 22 is preferably in the shape of a channel 32 extending for the full height of the body of the bracket 22.

The assembly 26 includes a body 38. A first projection 34 extends to one side from the upper end of the body 38. A second projection 36 extends from the lower end of the body 38, to the same side as projection 34. Thus, assembly 26 is C-shaped in section. Body 38 is provided with a guide surface such as tongue 40 which mates with and cooperates with the channel 32. However, it should be understood that bracket 22 may include a tongue, and body 38 of assembly 26 may include a channel for mating with the tongue. Fasteners such as threaded screws 42 removably secure the body 38 to the bracket 22. See FIG. 2. The projections 34 and 36 have a substantially larger cross-section as compared with the body 38 so that a rear face on the projections 34, 36 may be flush with the rear face of bracket 22. See FIG. 2.

The roller support assembly 26 includes an upright support member 44 which extends through and is guided by holes 46,47 in the projections 36 and 34, respectively. The projection 36 prevents the member 44 from rotating. This is preferably accomplished by making the hole 46 rectangular and by making the lower end of member 44 rectangular. Of course, other shapes other than circular shapes may be used for this purpose. Intermediate its ends, member 44 is provided with a shoulder 48 upon which a washer 49 is juxtaposed. A spring 50 surrounds a portion of member 44 between the projections 34, 36. The upright end of spring 50 contacts the bottom surface of projection 34. The lower of spring 50 engages the washer 49 juxtaposed to the shoulder 48. Spring 50 biases member 44 downwardly.

The projection 34 has a hole 47 therethrough which is aligned with the hole 46. The upper end of support member 44 extends through the hole 47 in projection 34 and terminates at its upper end in a threaded portion having a nut 52 attached thereto. The nut 52 contacts the upper surface on projection 34 due to the bias of spring 50. Nut 52 constitutes a means for limiting the downward extent of member 44. By adjusting nut 52, both the spring biasing and the height of roller 56 can be adjusted.

Each of the support members 44 has an inwardly directed cylindrical bearing 54 for rotatably supporting the ends of a roller 56. Roller 56 is preferably constructed so as to have a tube or hollow core 58 made from a lightweight non-corrosive material such as aluminum. A sleeve 60 surrounds the core 58 and may be secured thereto if desired in any convenient manner such as by the use of adhesives. The sleeve 60 is preferably made from a readily deformable material such as a foam polymeric plastic material. One such material is foam polyurethane having a smooth continuous skin on its outer periphery. Other material may be used, such as natural or synthetic rubber, felt, etc. The only requirements of the material for sleeve 60 are that it be deformable and substantially impervious to drafts. "Substantially impervious to drafts" means that a material effectively eliminates the flow of air under the door, even though it may technically be air pervious. Thus, the present invention is intended to be a substitute for the common practice of stuffing rags beneath a door to cut down drafts. Even though the rags are air pervious, they are effective in eliminating drafts, although they are cumbersome and inconvenient to use.

Sleeve 60 corresponds to the length of core 58. It is preferred to make the sleeve as long as possible to prevent drafts from going under the door 12. The combined length of roller 56 and the thickness of the support members 44 at the lower ends corresponds substantially to the width of the door 12. As shown more clearly in FIGS. 1 and 2, the side faces of the projections 34, 36 are flush with a side face of the door 12.

Drafts between the sill 16, if present, and the bottom edge of the door 12 are prevented by the roller 56. Nut 52 on each assembly is adjusted so as to provide uniform downward pressure on the ends of the roller 56 so that it preferably is deformed into contact with the door 12 and sill 16 as shown in FIG. 3. The amount of such deformation is approximately $\frac{1}{8}$th of an inch, although it may be greater depending on the pressure exerted by the spring and the deformability of the material used to make sleeve 60. Roller 56 will rotate about its longitudinal axis due to contact with the sill 16, with the floor 18 or with any carpet on the floor 18 as the door 12 is opened or closed. If no sill 16 is present, the roller will be deformed into contact with the door and the floor 18 or a carpet covering floor 18 to the extent necessary. Different roller diameters and different size mounting brackets and support assemblies may be used if necessary to bridge gaps larger than one standard size of the device 10.

During periods of warm weather or any other time when it is not desired to utilize the device 10 of the present invention, screws 42 are removed thereby separating the roller 56 and the assemblies 24, 26 from the door. The brackets 22 remain attached to the door and are sufficiently innocuous in appearance, weight and size so as to be permitted to remain attached to the door. The mating surfaces such as channel 32 and projection 40 prevent the assemblies from skewing with respect to their associated brackets so as to properly permit the roller 56 to rotate about its longitudinal axis without binding and to permit the support assemblies from binding as they travel vertically through holes 46, 47 in projections 36 and 34. As will be apparent from FIG. 3, the bias of spring 50 is downwardly directly in line with the longitudinal axis of roller 56 notwithstanding the fact that the assembly 26 is removably attached to the bracket 22, assembly 26 is generally C-shaped as shown in FIG. 1 and is a rigid structure having flush contact with the door 12 alongside of the bracket 22. Hence, neither the assembly 26 nor the member 44 may pivot or rotate about a horizontal axis or a vertical axis which would have the effect of causing a binding action between the bearing 54 and the roller 56. The spring 50 is chosen so as not to be so strong as to interfere with the ability of roller 56 moving upwardly against the biased spring 50 upon contact with the sill 16.

The present invention may be embodied in other specific forms without departing from the spirit or essential attributes thereof and, accordingly, reference should be made to the appended claims, rather than to the foregoing specifications, as indicating the scope of the invention.

We claim:

1. A door draft device for attachment to the lower end of a swinging door comprising:

a pair of mounting brackets each having a means for enabling the brackets to be secured to a door adjacent a side edge of the door, each bracket having a guide means on an exposed surface thereof;

a discrete roller support assembly for each bracket, means releasably securing each assembly to its associated bracket, each assembly including a guide surface mating with the guide means on its associated bracket in a manner so as to prevent each assembly from skewing and binding with respect to its bracket;

each assembly including a support member non-rotatably mounted thereon and guided for vertical movement, a spring biasing each support member downwardly, adjustable means for limiting the downward movement of each support member, said support members rotatably supporting a roller therebetween, said roller having a deformable outer surface substantially impervious to drafts;

whereby said assemblies and said roller may be removably separated from said brackets when desired.

2. A device in accordance with claim 1 wherein each assembly has a rear surface flush with a rear surface on its associated mounting bracket.

3. A device in accordance with claim 1 wherein said assembly is a rigid structure generally C-shaped with upper and lower projections being larger in cross-section than the upright portion extending therebetween, each projection having a hole through which the support member associated therewith extends.

4. A device in accordance with claim 1 wherein said guide means on said bracket is a vertical channel and the guide surface on the associated assembly is a projection extending into said channel.

5. A device in accordance with claim 4 wherein each assembly partially overlies a portion of its associated bracket and has a portion disposed alongside its associated bracket in contact with a side face of its associated bracket whereby the distance between the brackets is shorter than the distance between the assemblies.

6. A device in accordance with claim 1 wherein said roller comprises a tube having a deformable surface covering made of a material selected from the group of polymeric plastic material, rubber and felt.

7. A device in accordance with claim 1 wherein both spring biasing and roller height are adjustable by a nut mounted on a threaded portion of each support member.

* * * * *